US009695630B1

(12) United States Patent
Arthur

(10) Patent No.: US 9,695,630 B1
(45) Date of Patent: Jul. 4, 2017

(54) ATTIC INSULATION COVER

(71) Applicant: Southeast Energy Solutions, Inc., Lynchburg, VA (US)

(72) Inventor: Michael L. Arthur, Lynchburg, VA (US)

(73) Assignee: SOUTHEAST ENERGY SOLUTIONS INC., Lynchburg, VA (US)

( * ) Notice: Subject to any disclaimer, the term of this patent is extended or adjusted under 35 U.S.C. 154(b) by 0 days.

(21) Appl. No.: 15/337,065

(22) Filed: Oct. 28, 2016

Related U.S. Application Data

(60) Provisional application No. 62/319,886, filed on Apr. 8, 2016.

(51) Int. Cl.

| | |
|---|---|
| ***E06B 5/00*** | (2006.01) |
| ***E04F 11/06*** | (2006.01) |
| ***E04B 1/76*** | (2006.01) |
| *E06C 9/06* | (2006.01) |

(52) U.S. Cl.
CPC ..... *E06B 5/00* (2013.01); *E04B 1/76* (2013.01); *E06C 9/06* (2013.01)

(58) Field of Classification Search
CPC ..... E04F 11/062; E04F 11/064
See application file for complete search history.

(56) References Cited

U.S. PATENT DOCUMENTS

| | | | | | |
|---|---|---|---|---|---|
| 2,321,499 | A * | 6/1943 | Marschke | E04F 11/04 | 182/81 |
| 4,312,423 | A * | 1/1982 | Helbig | E04F 11/064 | 182/46 |
| 4,337,602 | A * | 7/1982 | King | E06B 5/01 | 182/46 |
| 4,832,153 | A * | 5/1989 | Daw | E04F 11/064 | 182/46 |
| 5,475,955 | A * | 12/1995 | Dickinson | E04F 11/064 | 182/46 |
| 5,628,151 | A * | 5/1997 | Monat | E04F 11/062 | 182/46 |
| RE36,975 | E * | 12/2000 | Williams | E04F 11/062 | 160/180 |
| 7,650,722 | B1 * | 1/2010 | Melesky | E04F 11/062 | 182/46 |
| 7,690,165 | B2 * | 4/2010 | Taylor | E06B 9/04 | 182/46 |
| 8,413,393 | B2 * | 4/2013 | Melesky | E04F 11/062 | 182/46 |
| 8,869,473 | B2 * | 10/2014 | Melesky | E04B 9/003 | 49/466 |

(Continued)

*Primary Examiner* — Robert Canfield
(74) *Attorney, Agent, or Firm* — Charles S. Sara; DeWitt, Ross & Stevens, S.C.

(57) ABSTRACT

An attic-insulation cover designed to cover access doors leading into attic spaces, such as pull down stairs, scuttle holes and vertical attic doors includes an attic insulation flange or border for placement over the attic opening frame, the attic insulation flange having a first top end and a second bottom end, an attic insulation jacket having a top wall, parallel side walls, parallel end walls and a bottom panel; and a closure device at the second bottom end of the attic-insulation flange for connecting the attic insulation flange and the attic insulation jacket.

20 Claims, 7 Drawing Sheets

(56) References Cited

U.S. PATENT DOCUMENTS

| | | | | |
|---|---|---|---|---|
| 2004/0055819 | A1* | 3/2004 | Lynn | E04B 9/003 182/46 |
| 2011/0225899 | A1* | 9/2011 | Melesky | E04B 9/003 52/19 |

* cited by examiner

ATTIC INSULATION COVER

CROSS-REFERENCE TO RELATED APPLICATION

The application claims priority to U.S. Provisional Application entitled "PULL DOWN LADDER JACKET," Ser. No. 62/319,886, filed Apr. 8, 2016, which is incorporated herein by reference in its entirety.

FIELD OF THE INVENTION

The present invention is directed to an attic-insulation cover designed to cover access doors leading into attic spaces, such as pulldown stairs, scuttle holes and vertical attic doors.

BACKGROUND

The present invention is directed to an attic-insulation cover which is designed to fit over and above a pulldown ladder or the like which enters the attic from the conditioned space of a residential house. The attic access is typically located in the hallway ceiling, but can be found in other rooms as well. It is always on the floor level of the house that meets the attic space.

The prior art includes various types of attic-insulation covers. Examples of such devices are as follows:

U.S. Patent RE 36,975 to Williams is directed to an attic hatchway cover, which includes a cover structure formed of insulative sidewalls, having a top wall utilizing a flexible flap, with access therethrough by a U-shaped zipper arranged to permit the pivoting of the top flap relative to the top wall of the hatchway cover. Each wall of the cover can include an inner wall spaced from an outer wall and having an insulated core therebetween.

U.S. Pat. No. 4,337,602 to King describes an attic ceiling enclosure with four walls, a top area and a zipper closure device. This invention uses a flexible envelope supported by some vertical posts. The envelope is rectangularly shaped and has a zipper fastener located about three of its sides to permit it to be opened and folded back on the non-fastener side.

US Publication 2007/0095608 to Taylor is directed to an insulating attic cover, which includes a hinged insulation jacket top, which rests upon a stiff border surrounding the attic stair opening. The insulation jacket can include thermal insulation and an insulated cover.

US Publication 2009/0094908 to Krueger et al. are directed to a fire-resistant insulated structure for an attic entryway. Although this does not appear to suggest the use of any insulation in the structure, it does have a closure device.

SUMMARY OF THE INVENTION

Reference numbers related to the figures accompanying this description. The present invention is directed to an attic-insulation cover 10 designed to cover an access opening 24 leading into attic spaces 30, such as pull down stairs, scuttle holes and vertical attic doors. The idea here is to create an attic insulator that fits over and above a pull down ladder 32 or the like which enters the attic from a conditioned space of a residential house.

More particularly, the present invention is directed to a flexible attic-insulation cover 10 for insulating an opening 24 in a ceiling, wherein the opening 24 includes an attic-opening frame 24 having spaced side walls 20, 22 and spaced end walls 17, 18, the attic-insulation cover 10 comprising (1) an attic insulation flange 100 adapted to be secured to the attic-opening frame 14; (2) an attic-insulation jacket 102, wherein the attic-insulation jacket 102 is removably secured to the attic-insulation flange 100, wherein the attic-insulation jacket 102 includes an insulation chamber 152; and (3) a closure device 104 for removably securing the attic-insulation flange 100 to the attic-insulation jacket 102.

The present invention is further directed to a flexible attic-insulation cover 10 for insulating an opening 24 in a ceiling, wherein the opening 24 includes an attic-opening frame 24 having spaced side walls 20, 22 and spaced end walls 17, 18. The attic-insulation cover 10 comprises an attic insulation flange 100 adapted to be secured to the attic-opening frame 24, wherein the attic-insulation flange 100 has a first upper end 116 and a second lower end 118, wherein the first upper end 116 is defined by the closure device 104. The attic-insulation cover 10 further comprises an attic-insulation jacket 102, wherein the attic-insulation jacket 102 is removably secured to the attic-insulation flange 100, wherein the insulation jacket 102 comprises a bottom panel 129 and a top panel 130, parallel sidewall panels 133, 135 and parallel ends 137, 139 thereby forming an interior chamber 152, wherein at least one end is open and at least one end is adapted to be removably closed, wherein the interior chamber 152 is adapted to receive and retain insulation 141, wherein the top panel 130 further includes at least one flexible extension flap 160, 162 on at least one of the top panel ends 137, 139, wherein the at least one extension flap 160, 162 is adapted to communicate with at least one end 143, 145 of the bottom panel 129 of the insulation jacket 102, and wherein the top panel extension flap 160, 162 and the bottom panel end 143, 145 include a communicating securement device 170 for releasably securing the top panel extension flap 160, 162 to the bottom panel end 143, 145. The attic insulation cover 10 further comprises a closure device 104 for removably securing the attic-insulation flange 100 to the attic-insulation jacket 102.

The primary purpose of this invention is to create an insulator to cover access doors leading into attic spaces such as pulldown stairs, scuttle holes and vertical attic doors. Advantageously, the present invention is easy to install and fits tightly to ceiling joists, while having insulation contained in the top of the product to provide a higher R-value than other products on the market. The ability to add insulation directly in the cover device is also an advantage. Further, the cover sets closer inside the attic opening which keeps better thermal resistance on the sides or the perimeter. This promotes savings on heating and cooling.

The insulation cover works well in the winter and summer to provide energy savings.

Further, the insulation cover creates an airtight seal around the attic access area thereby helping to prevent air leakage from the attic to the main part of a house and helps prevent the transmission of dust and other pollutants from coming into the living area of the house.

Another key advantage is convenience in packaging for storage and shipping. Because the expense of shipping an attic-insulation cover can be high, the present invention advantageously eliminates any major costs primarily because the material making up the attic-insulation cover of the present invention is primarily a flexible cloth-like material, which can be folded into a small package for storage and/or transport. The insulation does not necessarily have to be shipped, as insulation is prevalent at any hardware store or home store facility. When the attic-insulation cover arrives, it is a simple maneuver to unfold it for placement on a pull down ladder unit. If desired, insulation may then be obtained locally for insertion into the interior chamber of the insulation jacket.

The objects and advantages of the invention will appear more fully from the following detailed description of the preferred embodiment of the invention made in conjunction with the accompanying photographs.

BRIEF DESCRIPTION OF THE PHOTOGRAPHS

DETAILED DESCRIPTION OF THE INVENTION

Figure 1:
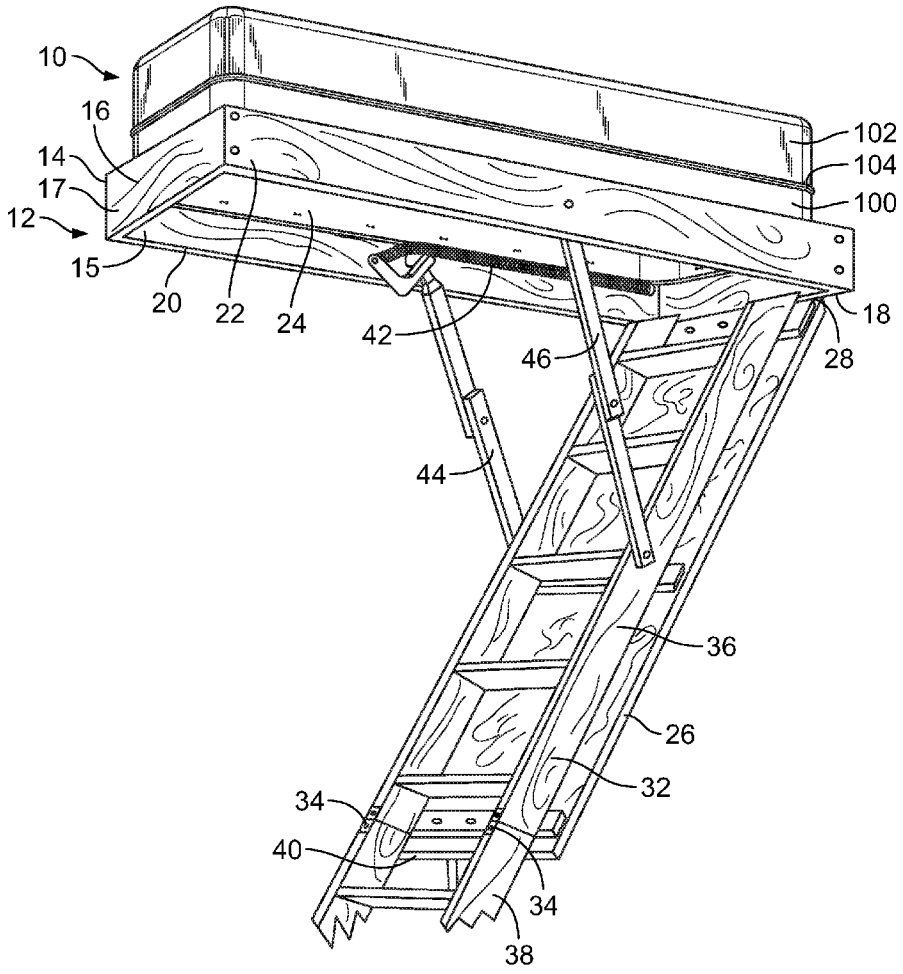
FIG. 1 is a perspective view of a pulldown ladder jacket of the present invention installed on a pulldown ladder.

With reference to FIG. 1, there is illustrated the attic-insulation cover 10 of the present invention in combination with a standard pulldown ladder unit 12, known to the art for access to building attic area or the like. While a pulldown ladder unit 12 is illustrated and described with respect to the attic-insulation cover 10 of the present invention, it within the scope of the present invention to use the attic-insulation cover 10 with other ingress openings such as standard scuttle holes, vertical attic ladders or simply supported openings in a ceiling for access to the attic.

Pulldown Ladder Unit 12

Figure 7:
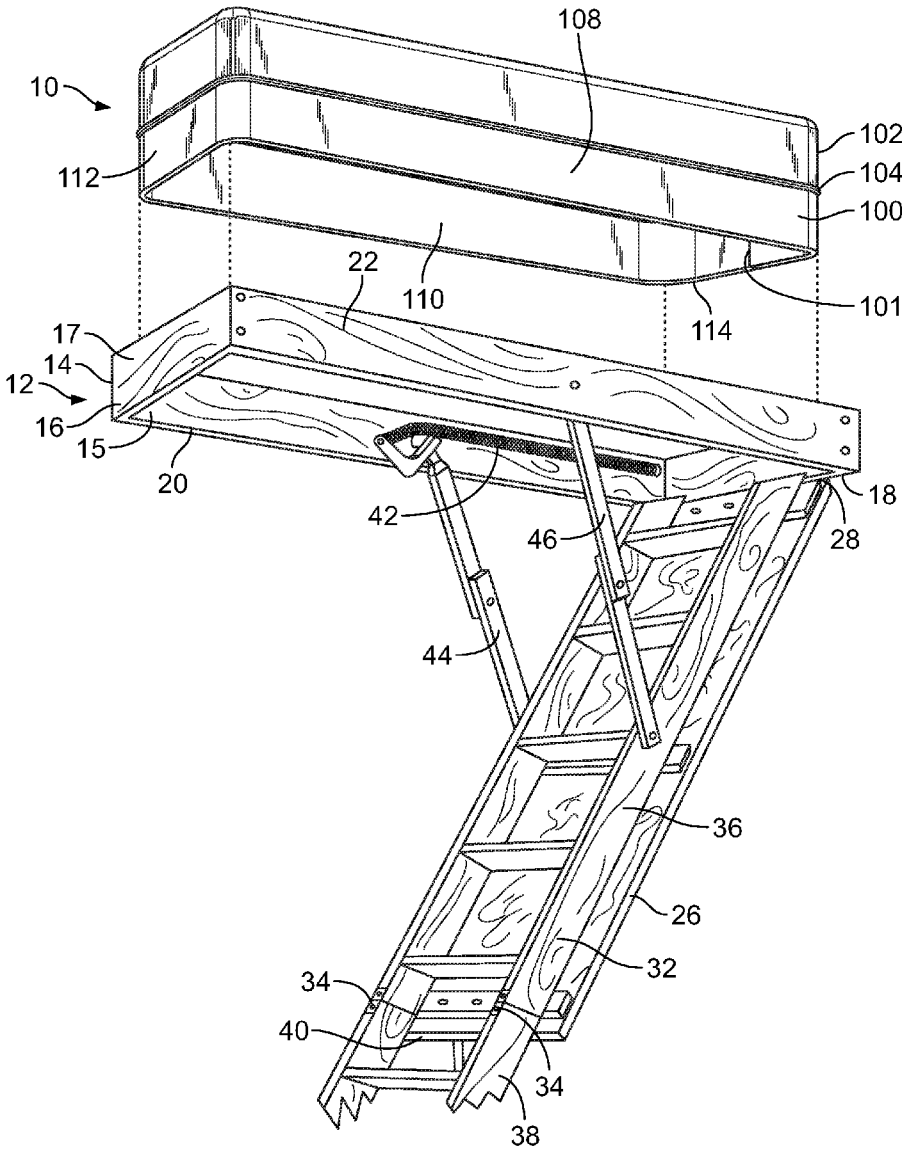
FIG. 7 is an exploded perspective view of the pulldown ladder jacket for placement on a pulldown ladder.
Figure 8:
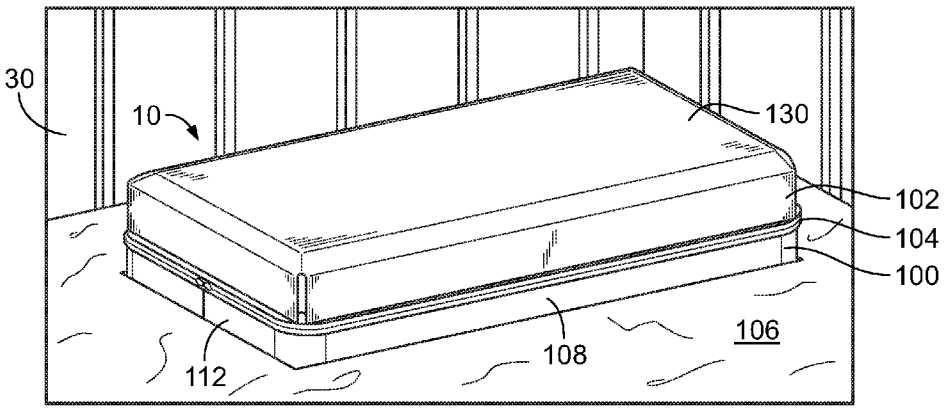
FIG. 8 is a top perspective view illustrating the pull down ladder jacket installed on a pull down ladder.
Figure 9:
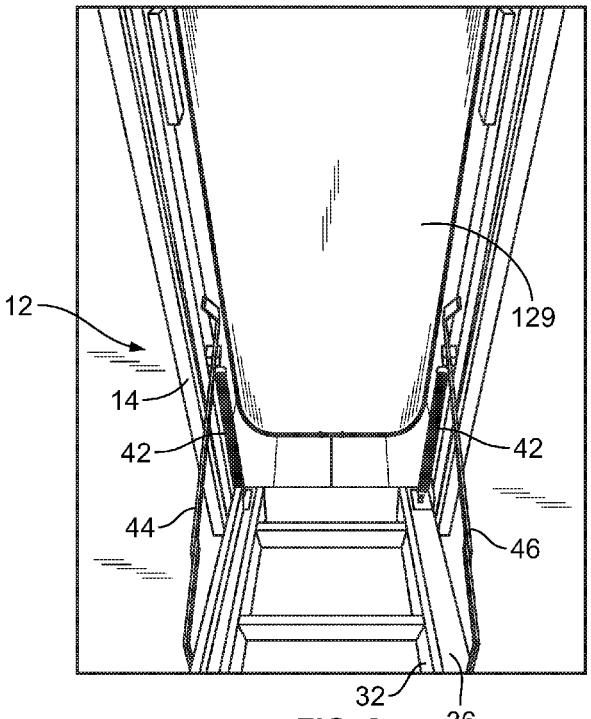
FIG. 9 is a bottom perspective view illustrating the pull down ladder jacket installed on a pull down ladder.
Figure 10:
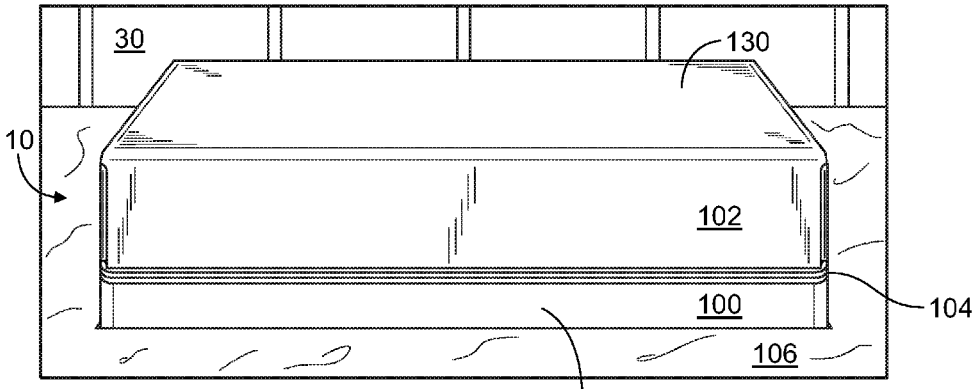
FIG. 10 is a perspective view of the pulldown ladder jacket of the present invention installed and closed on a pulldown ladder.

Referring to FIGS. 1, 7 and 9, a typical pulldown ladder unit 12 includes an attic-opening frame 14, which generally consists of a rectangular framework of boards, typically 2"×10" boards, formed by parallel constructed header boards 17, 18 attached to parallel well boards 20, 22, surrounding the attic opening 24 to form the framework. The frame 14 includes an interior surface 15 and an exterior surface 16. A door panel 26 is attached to the frame 14 at the header 18 by a piano hinge 28 to enable the door panel 26 to open by rotation on the piano hinge 28 for access to the attic space 30, illustrated in FIGS. 8, 10 and 11. A ladder 32 is attached to the door panel 26 as illustrated in FIGS. 1 and 7. As is well known in the industry, the ladder 32 can be segmented into sections, which are connected by hinges 34 to enable the ladder sections to fold upon themselves for storage on the door panel 26 when the door panel is closed. Illustrated in FIGS. 1 and 7 is an upper section 36 of the ladder 32 and a partial lower section 38 of the ladder 32.

To access the attic space 30, the free end 40 of the door panel 26 is pulled by a pull chain or the like (not illustrated) thereby allowing the door panel to rotate, via the piano hinge 28, into an open position. One or more tension springs 42 are used to prevent the door panel 26 from opening in an uncontrolled manner. Left and right spring arm assemblies 44, 46 assist in supporting the door panel 26 as it is being opened. Once opened, the sections 36, 38 (and others) of the ladder 32 may be unfolded to permit access through the attic opening 24 to the attic space 30.

Attic-Insulation Cover 10

Figure 2:
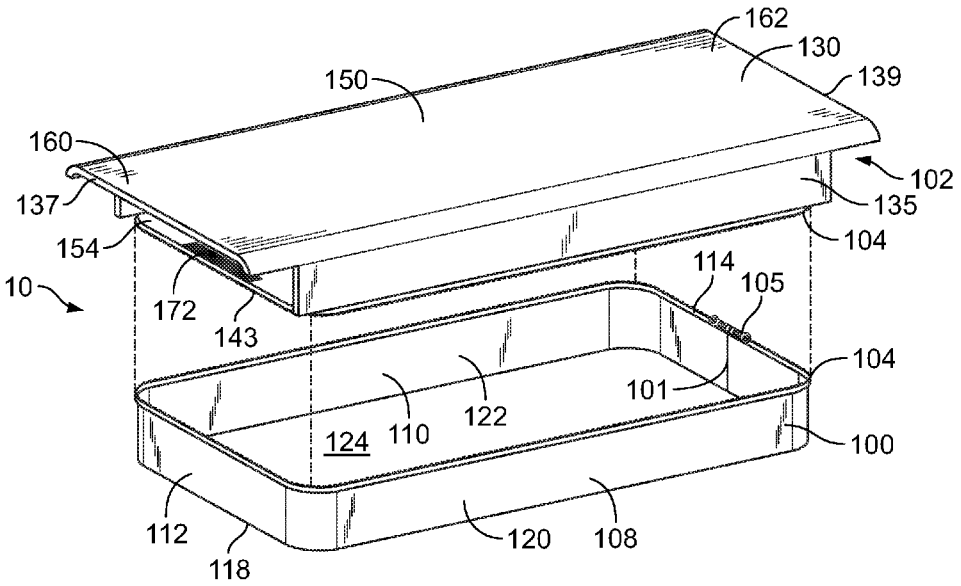
FIG. 2 is an exploded perspective view of the top portion of the pulldown ladder jacket of FIG. 1.

Referring now to FIGS. 1 and 2, the attic-insulation cover 10 of the present invention is defined by two separable units, an attic insulation flange 100 or border and an insulation jacket 102, which is removably secured to the flange 100 by a closure device 104, such as a zipper, hook and loop fastener, or the like. For purposes of describing the present invention, the closure device 104 will illustrated as a standard zipper.

Material for Constructing Attic-Insulation Cover 10

The material used for constructing the attic-insulation cover 10 is preferably a thick, rip stop or non-tearing flexible material, such as canvas, heavy or rubberized cotton or the like. The preferred material is fire proof or at least fire resistant. A preferred material for use in the construction of the attic-insulation cover 10 is a flexible two-sided foil faced foam insulation with ¼" inch nominal thickness, such as that produced by Environmentally Safe Products, Inc. (New Oxford, Pa. 17350). When using the preferred wall material as described, the insulation capacity is increased by around nine Rs.

Attic Insulation Flange 100

The attic insulation flange 100 is designed to fit within the attic-opening frame 14 and provides a border for attic insulation 106, illustrated in FIGS. 1, 8 and 9, to abut to it.

The attic insulation flange 100 is defined by elongated parallel side walls 108, 110 connected to parallel end walls 112, 114. The flange 100 is bordered by a first upper end 116, a second lower end 118, an exterior surface 120 and an interior surface 122 defining the flange opening 124. As illustrated in FIGS. 1-4, the first upper end 116 is defined by the closure device 104. The flange 100 is designed to fit within the interior surface 15 of the frame 14 in a generally snug fit relationship to minimize loss of insulation 106 from the attic space 30, as illustrated in FIG. 1.

Attic Insulation Jacket 102

The insulation jacket 102 is a separate component of the attic-insulation cover 10, which can be removably secured to the attic insulation flange 100 by means of the closure device 104, i.e., a zipper. As illustrated in FIGS. 1-4, the insulation jacket 102 includes a bottom panel 129 having an interior surface 132 and an exterior surface 134. The bottom panel 129 connects to parallel sidewall panels 133, 135 at edges 115, 117. The bottom panel 129 further includes ends 143 and 145. The sidewall panel 133 includes an interior surface 140 and an exterior surface 142. The sidewall panel 135 includes an interior surface 144 and an exterior surface 146. The attic insulation jacket 102 is completed with a top panel 130 having an interior surface 148 and an exterior surface 150.

The top panel 130 connects to side panels 133, 135 at edges 136, 138 and includes ends 137, 139. The connected panels 129, 130, 133 and 135 form an interior chamber 152 with openings 154 and 156 at either end of the attic insulation jacket 102. The interior chamber 152 is designed to receive insulation 141 as will be described further on. Accordingly, the sidewalls 133, 135 are preferably between about seven and fifteen inches high such that the interior chamber 152 can accommodate the insulation 141.

Figure 5:
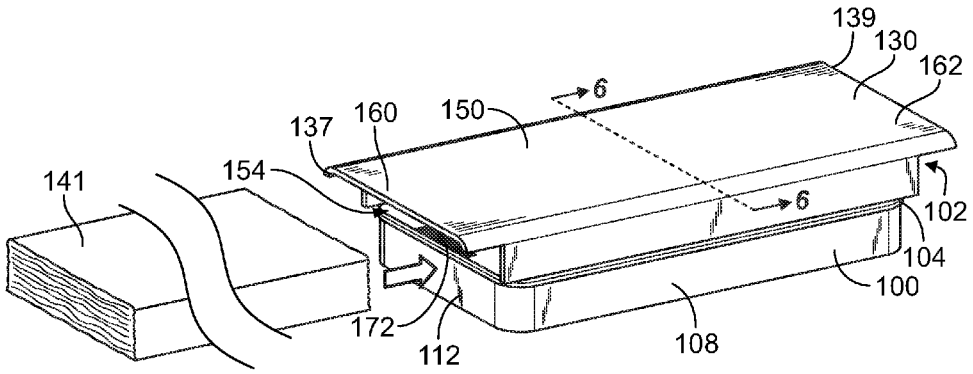
FIG. 5 is a perspective view of the pulldown ladder jacket of FIG. 1 illustrating the installation of a batt of insulation.
Figure 6:
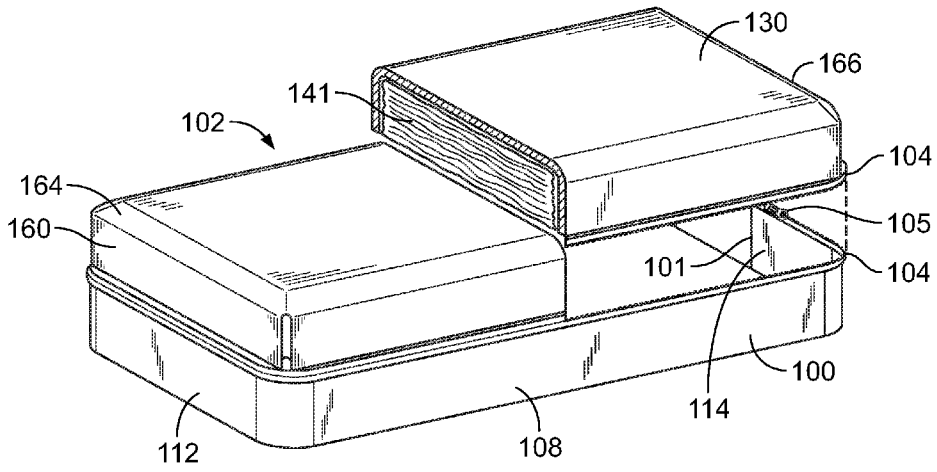
FIG. 6 is a partial cutaway perspective view of the pulldown ladder jack of FIG. 5 taken at lines 6-6 of FIG. 5.

The top panel 130 further includes at least one and preferably two flexible extension flaps 160, 162 on either end 137, 139 of the top panel 130. As illustrated in FIGS. 5 and 6, the extension flaps 160, 162 are designed to fold forming creases 164, 166 such that the ends 137, 139 of the extension flaps 160, 162 will come into communication with the ends 143, 145 of the bottom panel 108.

Figure 3:
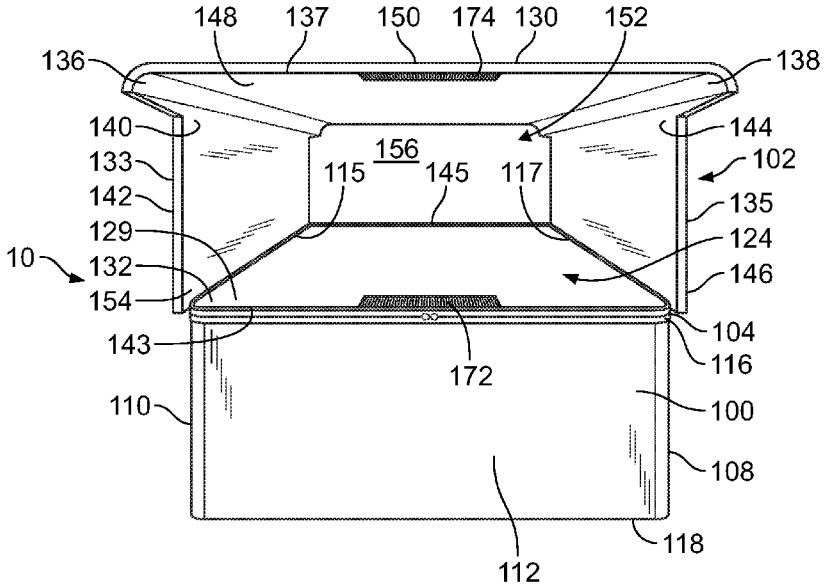
FIG. 3 is an end view of the top portion of the pulldown ladder jacket of FIG. 2 illustrating two open ends.
Figure 4:
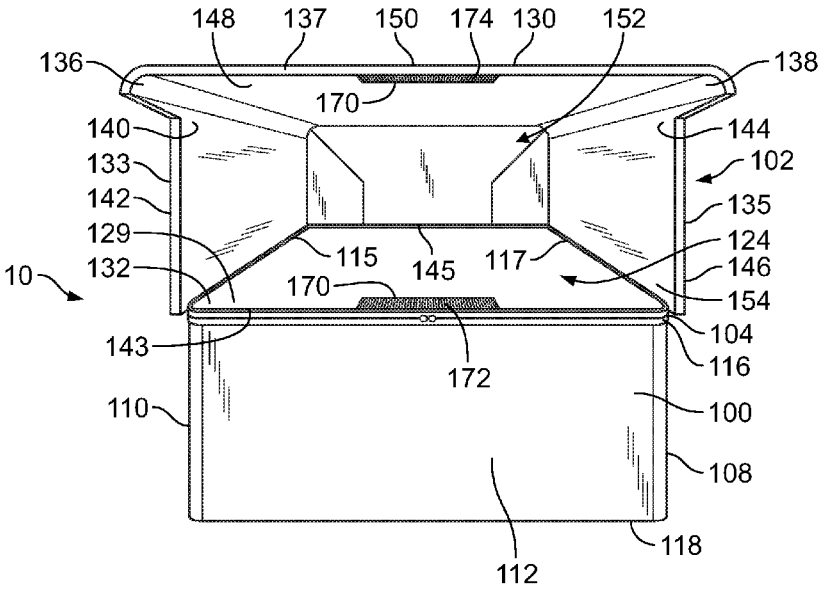
FIG. 4 is an end view of the top portion of the pulldown ladder jacket of FIG. 3 illustrating one open end and one closed end.

As illustrated in FIGS. 3-5, a securement device 170 is provided for adhering the ends 137, 139 to ends 143, 145 respectively. As illustrated in the drawings, the securement device 170 is preferably releasable, such as a co-acting hook and loop, i.e., VELCRO connector. However, the securement device 170 can also be snaps, buttons, staples, zippers, needle and thread or any other type of device known for securing the ends together. If desired, the attic insulation jacket can be permanently closed at one end, as illustrated in FIG. 4, leaving the other end open to receive the insulation 141. For purposes of illustration, the securement device 170 is of the hook and loop or VELCRO variety, having a first securing piece 172 attached, by glue, stitching or other means, to ends 143, 145 of the bottom panel 129 of the attic insulation jacket 102. A second securing piece 174 is attached to the ends 137, 139 of the extension flaps 160, 162 on the interior surface 148 of the top panel 130. To close off the interior chamber 152 of the attic insulation jacket 102, the extension flaps 160, 162 are creased and bent at edges 164, 166 such that the ends 137, 139 of the extension flaps 160, 162 come into contact with the ends 143, 145 of the bottom panel 129 to allowed the securing pieces 172, 174 to releasably connect.

Insulation

Once the attic insulation jacket 102 is constructed, insulation 141 is preferably installed within the interior chamber 152 of the insulation jacket 102, as illustrated in FIGS. 4-6. While there are a variety of forms of insulation 141 for placement within the interior chamber 140, a preferred form is a standard "batt" of insulation 141 known to the art. The interior chamber 152, illustrated in FIG. 4, is preferably designed to accommodate a standard batt of insulation 141, illustrated in FIG. 5, having standard dimensions of approximately three feet wide and one foot high. The length of the batt of insulation 141 can be cut to accommodate the length of the insulation jacket 102. Typical batt of insulation 141 will have an R-38 insulation factor although the attic insulation jacket 102 can hold insulation having an R-49 factor or more.

The extension flaps 160, 162 of the top panel 130 are then secured as described above to retain the insulation 141 within the interior chamber 152 of the attic insulation jacket. While insulation 141 is not required to be placed within the interior of the insulation jacket, it is desired to do so in order to enhance the insulation ability of the pulldown ladder jacket 12.

Construction of the Attic-Insulation Cover 10

Following is a description of the preferred materials for constructing the pulldown ladder jacket 12 of the present invention. While these preferred materials are described, it is within the scope of the present invention to use other materials known to the art.

As described previously, the wall material is preferably made of 2-sided foil faced foam insulation with ¼" inch nominal thickness. The preferred material is produced by Environmentally Safe Products, Inc. (New Oxford, Pa. 17350). Other fabric material, such as canvas, cotton and other preferably heavy grade materials can also be used for this invention.

The closure device 104 is preferably a nylon coil zipper, typically a 5-gauge 1-inch zipper and made of 100% polyester, catalog #688, manufactured by Lenzip Manufacturing Corporation (Rolling Meadows, Ill.). Non-lock long pull #5 gauge sliders catalog #487 are attached to the zipper coil. Although zippers are the preferred closure device, it is within the scope to use other connectors, such as hook and loop (VELCRO) fasteners and the like.

The attic-insulation cover 10 is preferably constructed by a sewing machine using T-60 Edd core PCP black nylon thread T/II AA50199 (Eddington Thread Manufacturing, Bensalem, Pa.). The hook and loop fasteners are preferably 1-inch wide industrial strength VELCRO strips, model #624 (Velcro USA, Inc., Manchester, N.H.).

A preferred process for manufacturing the attic-insulation cover 10 of the present invention uses the following steps:

- Cut off a piece of 1-inch coil zipper, 12 feet long and attach two of the non-locking zipper sliders on the zipper; the noses of each slider must be facing each other once in place.
- Cut 1 piece of the 10-inch foil-faced foam insulation at thirteen feet.
- Get a sheet of 24" by 55" piece of foam insulation.
- Sew one-half of the piece of coil zipper around the perimeter of the sheeted piece of foam insulation.
- Take the 10" piece of foil-faced foam insulation and sew the other half of the coil zipper around one side of that piece which forms the bottom part or the flange of the jacket.
- Take a 42"×68" oversized piece of sheeted insulation, i.e., the top panel 130 and sew it to the 24"×55" piece (the bottom panel 129) on the long sides only. Once sewn together, this creates the attic insulation jacket 102, which forms the interior chamber 152 to receive the insulation 141.
- As the top panel 130 is around 13" longer than the bottom panel 129, this results in a 6½" overlap on the ends 137, 139, the extension flaps 160, 162, to fold down and close off interior chamber 152 once the insulation 141 is inserted to prevent loss of the insulation 141.
- To create the securement device 170, a piece of approximately 6" hook and loop (VELCRO) adhesive strip is placed on the interior surface 148 of the top panel 130 at both ends 137, 139. The mating pieces of hook and loop adhesive strips are then adhered to the interior surface 132 of the bottom panel 129 at ends 143, 145.

Figure 4A:
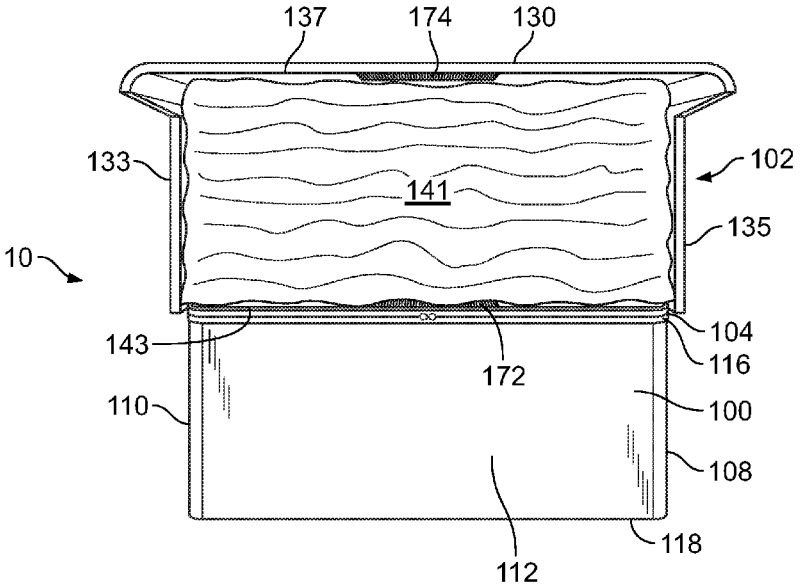
FIG. 4A is an end view of the top portion of the pulldown ladder jacket of FIG. 4 with insulation.

Once the pulldown ladder jacket 102 is fully constructed, it is now ready to be attached to the attic-opening frame 14 of the pulldown ladder unit 12, as illustrated in FIGS. 7-9. Alternatively and preferably, a batt of insulation 141 is installed within the interior chamber 152 of the insulation jacket 102, as illustrated in FIGS. 4A, 5 and 6.

The extension flaps 160, 162 on the top panel 130 of the insulation jacket 102 are then creased at lines 164, 166 and folded downwardly such that the first securing pieces 174 on the ends 137, 139 of the top panel 130 meet the second securing pieces 172 on the ends 143, 145 of the bottom panel 129, as illustrated in FIGS. 5-6.

Installation of the Attic-Insulation Cover 10 on the Pulldown Ladder Unit 12

One distinct advantage of the attic-insulation cover 10 of the present invention is the ease of installation. The attic-insulation cover 10 itself is relatively light, typically weighing less than about 20 pounds even with the insulation 141 installed within the interior chamber 152 of the insulation jacket 102. In addition, the material making up the attic-insulation cover 10 is flexible thereby allowing the device 10 itself to be easily transported and manipulated during installation.

While the attic-insulation cover 10 as described above is preferably designed for installation on an attic opening frame 14 having 54 inch well boards 20, 22 and 22½ inch header boards 17, 18, it is within the scope of the present invention to adjust the dimensions of the attic-insulation cover 10 to meet the specifications of attic openings 24 of any dimension.

Once the attic-insulation cover 10 has been prepared, it is now ready for installation. With reference to FIGS. 1, 7, 8 and 9, the attic-insulation cover is positioned such that the flange 100 is fitted within the interior of the frame 14, as illustrated in FIGS. 7 and 9. As an added advantage of the installation of the flange 100 in this manner, the flange 100 eliminates the need for a weather stripping frame because the flange 100 itself acts as a weather strip. As illustrated in FIGS. 2, 6 and 7, the flange 100 preferably includes an open, overlapping section at seam 101 to assist in the positioning of the flange 100 with respect to the frame 14.

Once the flange 100 has been installed, the flange can be secured to the frame 14 by securing devices known to the art, such as stapler, nails or glue. Once the flange has been secured to the frame 14, a caulking material can be applied to the gap between the flange 100 and the frame 14 to prevent further loss of heat or cool air.

FIG. 9 is a bottom perspective view of the ladder jacket 10 of FIG. 1 illustrating the open door panel 26 and the pulldown ladder 32. As illustrated, the flange 100 and the bottom panel 129 of the insulation jacket 12 are visible. The insulation jacket 12 is secured to the flange 100 by means of the closure device 104, i.e., a zipper extending around the perimeter of the insulation jacket 12.

Figure 11:
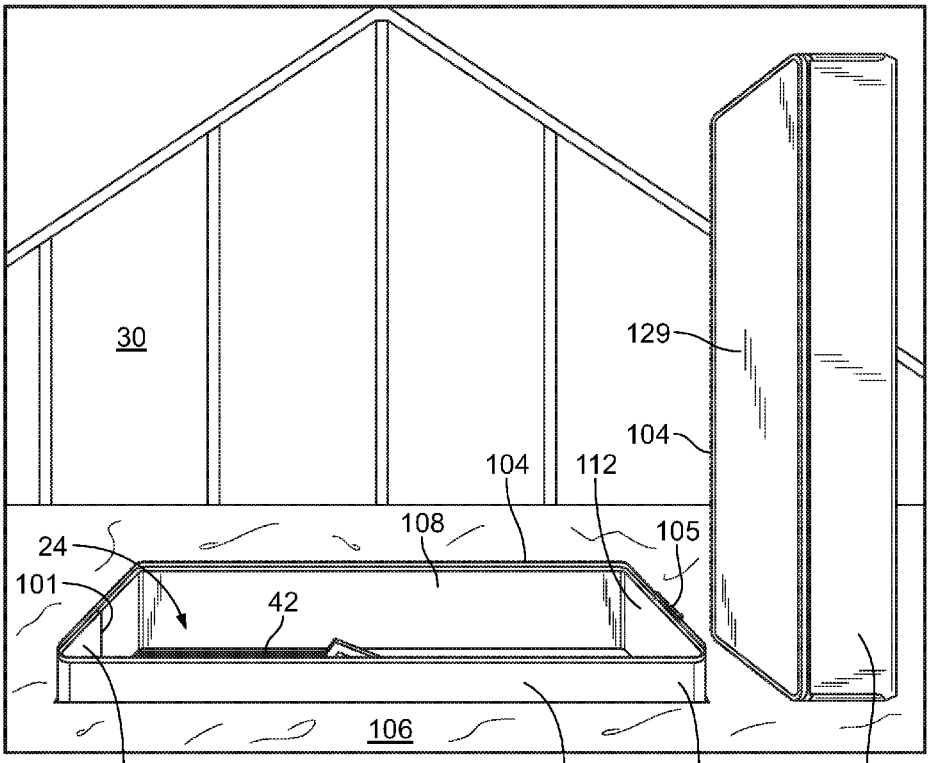
FIG. 11 is a perspective view of the pulldown ladder jacket of the present invention removed from the pulldown ladder.

As illustrated in FIGS. 1, AND 8-11, the attic-insulation cover 10 is ready to use either to insulate the attic opening 24 or to allow access to the attic space 30. To access the attic space 30, the closure device 104 is separated. If a zipper is used, the zipper is separated by pulling the zipper pulls 105 thereby separating the insulation jacket 102 from the flange 100, as illustrated in FIG. 11, to lift the insulation jacket 102 from the flange 100 for access to the attic space 30. Reattaching the insulation jacket 102 to the flange 100 to close off the attic opening 24 is an easy procedure, which essentially reserves the steps described above with respect to gaining access to the attic space 30.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. An attic-insulation cover for insulating an opening in a ceiling, wherein the opening includes an attic-opening frame having spaced side walls and spaced end walls, the attic-insulation cover comprising:

a. an attic insulation flange adapted to be secured to the attic-opening frame;

b. an attic-insulation jacket, wherein the attic-insulation jacket is removably secured to the attic-insulation flange, wherein the attic-insulation jacket comprises a bottom panel and a top panel, parallel sidewall panels and parallel ends, wherein one end is open and at least one end is adapted to be removably closed, thereby forming an insulation chamber; and c. a closure device for removably securing the attic-insulation flange to the attic-insulation jacket.

2. The attic-insulation cover of claim 1 wherein the closure device is selected from the group consisting of a zipper and a hook and loop fastener.

3. The attic-insulation cover of claim 1 wherein the closure device is a zipper.

4. The attic-insulation cover of claim 1, wherein the opening includes a pulldown ladder unit, wherein the pulldown ladder unit includes a substantially rectangular attic-opening frame, a door panel rotatably connected to the frame, and a ladder connected to the door panel.

5. The attic-insulation cover of claim 1, wherein the attic-insulation flange has a first upper end and a second lower end, wherein the first upper end is defined by the closure device.

6. The attic-insulation cover of claim 1, wherein the insulation chamber is adapted to receive and retain insulation.

7. The attic-insulation cover of claim 6, wherein the insulation is a batt of insulation sized to fit within the insulation chamber of the attic-insulation jacket.

8. The attic-insulation cover of claim 1, wherein both ends of the attic-insulation jacket are open for receiving insulation.

9. The attic-insulation cover of claim 1, wherein the attic-insulation cover is comprised of insulated wall material.

10. An attic-insulation cover, for insulating an opening in a ceiling, wherein the opening includes an attic-opening frame having spaced side walls and spaced end walls, the attic-insulation cover comprising:

a. an attic insulation flange adapted to be secured to the attic-opening frame;

b. an attic-insulation jacket, wherein the attic-insulation jacket is removably secured to the attic-insulation flange, wherein the attic-insulation jacket comprises a bottom panel and a top panel, parallel sidewall panels and parallel ends, wherein one end is open and at least one end is adapted to be removably closed, thereby forming an insulation chamber, wherein the top panel further includes at least one extension flap on at least one of the top panel ends, wherein the at least one extension flap is adapted to communicate with at least one end of the bottom panel of the attic-insulation jacket, and c. a closure device for removably securing the attic-insulation flange to the attic-insulation jacket.

11. The attic-insulation cover of claim 10, wherein the top panel extension flap and the interior surface of the bottom panel include a communicating securement device for releasably securing the at least one top panel extension flap to the bottom panel end.

12. The attic-insulation cover of claim 10, wherein the securement device is a hook and loop connector.

13. A attic-insulation cover for insulating an opening in a ceiling, wherein the opening includes an attic-opening frame having spaced side walls and spaced end walls, the attic-insulation cover comprising:

a. an attic insulation flange adapted to be secured to the attic-opening frame, wherein the attic-insulation flange has a first upper end and a second lower end, wherein the first upper end is defined by a closure device;

b. an attic-insulation jacket, i. wherein the attic-insulation jacket is removably secured to the attic-insulation flange, ii. wherein the attic-insulation jacket comprises a bottom panel and a top panel, parallel sidewall panels and parallel ends thereby forming an interior chamber, iii. wherein at least one end is open and at least one end is adapted to be removably closed, wherein the interior chamber is adapted to receive and retain insulation, iv. wherein the top panel further includes at least one extension flap on at least one of the top panel ends, v. wherein the at least one extension flap is adapted to communicate with one end of the bottom panel of the attic-insulation jacket, and vi. wherein the at least one extension flap and the interior surface of the bottom panel include a communicating securement device for releasably securing the at least one extension flap to the bottom panel end; and c. a closure device for removably securing the attic-insulation flange to the attic-insulation jacket.

14. The attic-insulation cover of claim 13 wherein the closure device is selected from the group consisting of a zipper and a hook and loop fastener.

15. The attic-insulation cover of claim 13 wherein the closure device is a zipper.

16. The attic-insulation cover of claim 13, wherein the opening includes a pulldown ladder unit, wherein the pulldown ladder unit includes a substantially rectangular attic-opening frame, a door panel rotatably connected to the frame, and a ladder connected to the door panel.

17. The attic-insulation cover of claim 13, wherein the insulation is a batt of insulation sized to fit within the interior chamber of the attic-insulation jacket.

18. The attic-insulation cover of claim 13, wherein the securement device is a hook and loop connector.

19. The attic-insulation cover of claim 13, wherein both ends of the attic-insulation jacket are open for receiving insulation.

20. The attic-insulation cover of claim 13, wherein the attic-insulation cover is comprised of insulated wall material.

* * * * *